US008397704B1

(12) United States Patent
Gore

(10) Patent No.: US 8,397,704 B1
(45) **Date of Patent: *Mar. 19, 2013**

(54) AIR GUN ASSEMBLY

(76) Inventor: Thomas Gore, South Lyon, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/448,771

(22) Filed: Apr. 17, 2012

Related U.S. Application Data

(63) Continuation of application No. 12/946,300, filed on Nov. 15, 2010, now Pat. No. 8,156,929, which is a continuation of application No. 12/194,615, filed on Aug. 20, 2008, now Pat. No. 7,854,221.

(51) Int. Cl.
*F41B 11/00* (2006.01)

(52) U.S. Cl. ..... 124/63

(58) Field of Classification Search ..... 124/63–68; 89/198, 7; 42/74
See application file for complete search history.

(56) References Cited

U.S. PATENT DOCUMENTS

| | | | | | |
|---|---|---|---|---|---|
| 3,090,151 | A * | 5/1963 | Stewart et al. | 43/6 |
| 4,038,961 | A * | 8/1977 | Olofsson | 124/69 |
| 4,307,653 | A * | 12/1981 | Goes et al. | 89/198 |
| 4,388,855 | A * | 6/1983 | Sokolovsky | 89/198 |
| 4,709,686 | A * | 12/1987 | Taylor et al. | 124/67 |
| 4,771,758 | A * | 9/1988 | Taylor et al. | 124/68 |
| 4,848,307 | A * | 7/1989 | Tsao | 124/59 |
| 4,850,329 | A * | 7/1989 | Taylor et al. | 124/68 |
| 4,883,042 | A * | 11/1989 | Wackrow | 124/67 |
| 5,193,517 | A * | 3/1993 | Taylor et al. | 124/67 |
| 5,261,384 | A * | 11/1993 | Hu | 124/66 |
| 5,377,655 | A * | 1/1995 | Arad | 124/65 |
| 5,531,039 | A * | 7/1996 | Gore | 42/124 |
| 5,570,676 | A * | 11/1996 | Gore | 124/56 |
| 6,668,478 | B2 * | 12/2003 | Bergstrom | 42/1.06 |
| 6,901,689 | B1 * | 6/2005 | Bergstrom | 42/1.06 |
| 7,854,221 | B1 * | 12/2010 | Gore | 124/63 |
| 8,132,563 | B2 * | 3/2012 | Gore | 124/65 |
| 8,156,929 | B1 * | 4/2012 | Gore | 124/63 |
| 2002/0178901 | A1 * | 12/2002 | Bergstrom | 89/198 |
| 2006/0124118 | A1 * | 6/2006 | Dobbins | 124/77 |
| 2010/0059033 | A1 * | 3/2010 | Gore | 124/68 |
| 2010/0101550 | A1 * | 4/2010 | Carnall | 124/76 |
| 2010/0108049 | A1 * | 5/2010 | Dobbins | 124/77 |
| 2010/0229844 | A1 * | 9/2010 | Gore | 124/80 |
| 2011/0017186 | A1 * | 1/2011 | Gore | 124/66 |

* cited by examiner

*Primary Examiner* — Michael David
(74) *Attorney, Agent, or Firm* — Quinn Law Group, PLLC

(57) ABSTRACT

An assembly for an air gun that has a gas spring includes a sleeve contacting the gas spring. The sleeve may damp vibrations in the air gun when the gun is fired.

21 Claims, 5 Drawing Sheets

AIR GUN ASSEMBLY

CROSS-REFERENCE TO RELATED APPLICATIONS

This application is a continuation application of U.S. application Ser. No. 12/946,300, filed Nov. 15, 2010, which is a continuation of U.S. application Ser. No. 12/194,615, filed Aug. 20, 2008, both of which are hereby incorporated by reference in their entireties.

TECHNICAL FIELD

This invention relates to air guns and more particularly to a vibration damper for the force producing/charging assembly of a gas spring air gun.

BACKGROUND

Air guns use compressed air to discharge a pellet. Some air guns use a firing piston in a compression tube defining a compression chamber. In a gas spring-type air gun, the air gun is charged by moving this compression piston toward the trigger to compress a gas contained within a gas spring's cylinder behind the compression piston.

The gas spring is mounted between the compression piston and a trigger mechanism. The compression piston is retracted to cock the trigger and to compress the gas contained within the gas spring. The gas within the gas spring is compressed by a second piston, hereinafter, the spring piston. When the trigger is released, the gas spring launches the compression piston toward the barrel to compress the air in the compression chamber. The compressed air then propels the pellet through the barrel. One problem with air guns using a gas spring is that the rapid deceleration of both the compression piston and the spring piston produce an excessive amount of vibration shock, harmonics, and harshness (hereinafter collectively referred to as "vibration") upon firing.

These gas-powered air guns suffer from inaccuracy due to the vibration resulting from the rapid movement, then rapid deceleration of the pistons during firing. There is therefore a need for an improved air gun charging system damper that overcomes these and other drawbacks of prior art designs and techniques.

SUMMARY

An assembly for an air gun is provided that may advantageously damp vibrations in a gas spring both during and after firing. The air gun may have a movable compression piston. In one embodiment, the assembly includes a gas spring that has a gas spring body defining an interior chamber, and a gas spring piston movable relative to the interior chamber. A portion of the gas spring piston engages the compression piston. A sleeve contacts an outer surface of the gas spring body.

In one embodiment, the gas spring is at least partially disposed within a compression tube. The assembly includes a damping component contacting the gas spring and the compression tube. The damping component may damp vibrations in the air gun when the gun is fired.

One advantage of the sleeve is that it may provide a large surface area to abut and absorb vibrations from the gas spring.

One advantage of the sleeve is that it may improve projectile velocities and accuracies by damping the vibrations caused by the gas spring. Further, the damping component may remain free from contact with the moving portions of the gas spring during the firing sequence.

The above features and advantages and other features and advantages of the present invention are readily apparent from the following detailed description of the best modes for carrying out the invention when taken in connection with the accompanying drawings.

BRIEF DESCRIPTION OF THE DRAWINGS

The description refers to the accompanying drawings in which like reference characters refer to like parts throughout the several views, and in which.

DETAILED DESCRIPTION

Figure 1:
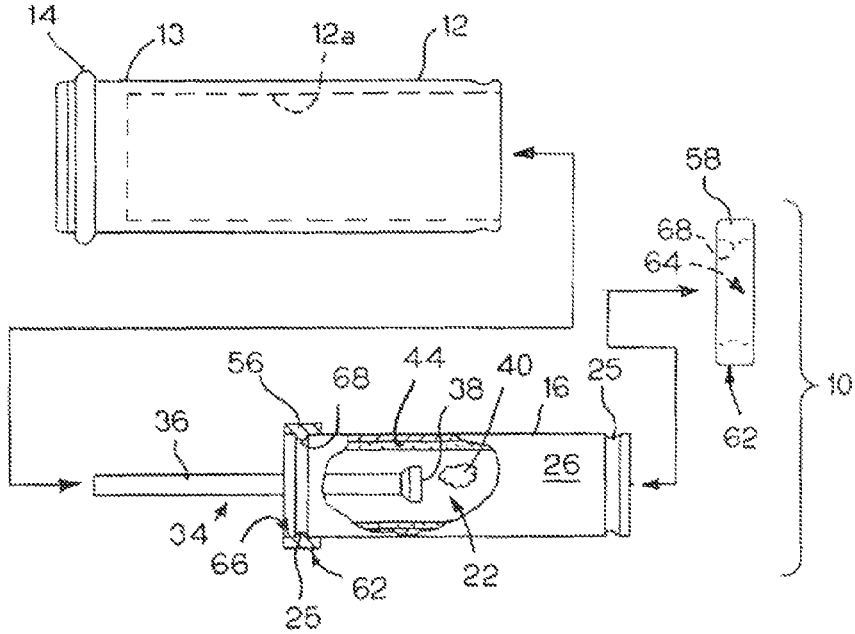
FIG. 1 is a partially exploded, partially cut-away side view of an improved gas spring along with a conventional skirted compression piston.
Figure 2:
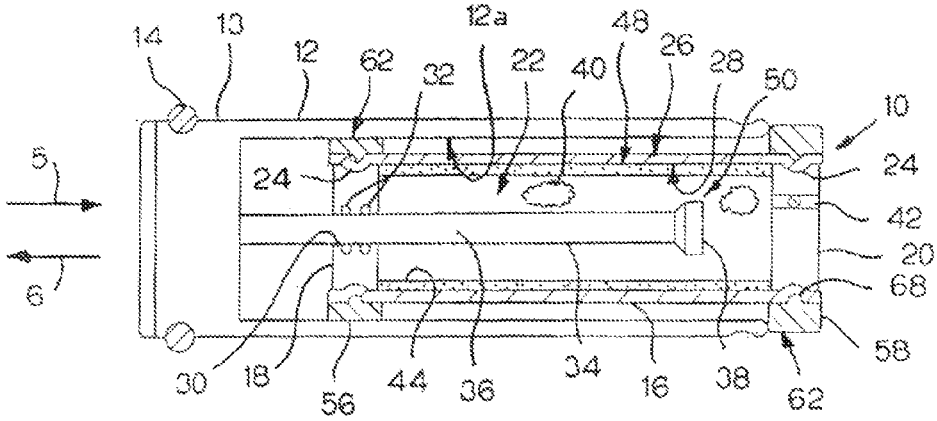
FIG. 2 is a side sectional view of the improved gas spring gun in a cocked position within a compression piston.
Figure 3:
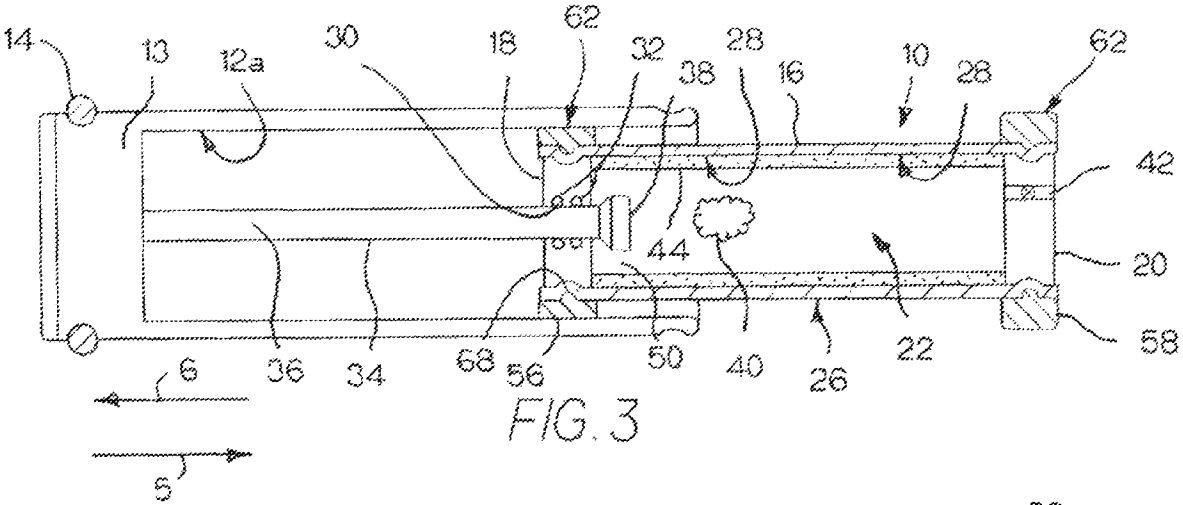
FIG. 3 is a side sectional view of the improved gas spring gun in a post-firing position within a compression piston.

Referring now to FIGS. 1-3, a gas spring 10 is shown along with a tubular shaped or skirted compression piston 12 for an air-powered pellet gun. The compression piston 12 is conventional and has a front end or head 13 having a dynamic seal or gasket 14 which creates an air-tight seal between compression piston 12 and the inner surface of the air gun's compression tube (not shown). In a typical air gun, the compression tube and compression piston 12 are substantially in-line with the air gun's barrel (not shown), such that once the air gun's trigger is pulled, the compression piston 12 moves toward the barrel and compresses the air in the compression tube in front of the piston head 13 expelling a projection, e.g., a pellet, out of the barrel.

Gas spring 10 includes an elongated tubular body 16. A pair of end walls or plugs 18, 20 are fixed to body 16 to define a pressure chamber 22, also referred to herein as a compression chamber. In the embodiment shown, plugs 18, 20 are fixed within the chamber 22 by roll forming annular projections 24 in body 16. By roll forming the projections 24, a small channel 25 is formed in the outer surface 26 of the body 16. It should be appreciated that plugs 18, 20 may be affixed to body 16 in substantially any manner suitable to create and air-tight condition within pressure chamber 22 and may include a seal or gasket (not shown) between the inner surface 28 of body 16 and the plugs.

Front plug 18 includes a central opening 30, which is preferably co-axial to the longitudinal axis of body 16. Opening 30 includes a dynamic seal or o-rings 32 that are mounted within concentric channels formed in the cylindrical inner wall plug 18.

Gas spring 10 further includes a piston 34. Piston 34 has an elongated and rigid piston rod 36. An enlarged retainer head 38 is mounted at one end of rod 36. Piston 34 is mounted within body 16 and projects through opening 30 with retaining head 38 contained within chamber 22. Dynamic seal 32 cooperates with rod 36 to create the airtight condition within chamber 22. Piston 34 is movable axially from a cocked or ready to-fire position, generally shown in FIG. 2, to a post-firing position shown in FIG. 3. As shown in FIGS. 2 and 3, the forward-most end of rod 36 engages a portion of the skirted compression piston 12, e.g., the rearward wall of head 13, such that movement of the compression piston 12 in the direction of arrow 5 (when cocking the air gun) will force rod 36 further into chamber 22; and such that movement of the gas spring piston 34 in the direction of arrow 6 (when the air gun is fired) will force the compression piston 12 toward the air gun's barrel.

An amount of pressurized gas 40, such as air, is trapped within chamber 22 and the additional volume occupied by the piston 34 when it is in the cocked position further pressurizes the gas 40. In the embodiment shown in the FIGs., an inlet valve 42 in rear plug 20 allows the pressure within chamber 22 to be adjusted.

Gas spring 10 further includes a liner or lining 44 of vibration damping or absorbing material. As shown, liner 44 is disposed within chamber 22 and abuts the inner wall 28 of body 16 face-wise. That is, the outer surface 48 of liner 44 conforms to and abuts substantially the entire surface of cylindrically-shaped inner wall 28. Liner 44 also preferably runs the entire length of chamber 22 to maximize the surface area covered by the vibration damping or absorbing liner. Liner 44 is preferably formed from an elastomeric material, such as rubber, which is sufficiently rigid to remain in place against the inner wall 28 of body 16, while still damping any vibrations that pass into the liner.

Importantly, liner 44 is relatively thin to leave an adequate gap 50 between its inner-most surface 52 and the radially projecting retaining head 38. This clearance or gap 50 ensures that the piston 34 will not be slowed by liner 44 when the gas spring is cocked/compressed and while the piston 34 is traveling forward when the air gun is fired, i.e., toward the post-firing position shown in FIG. 3.

Figure 4:
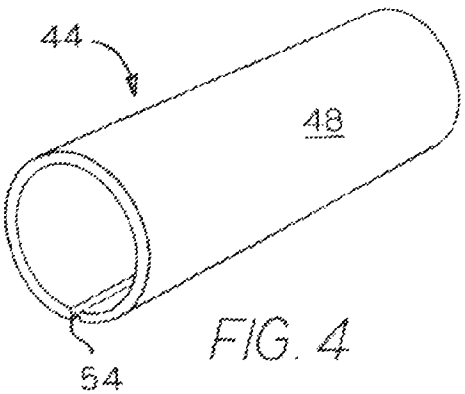
FIG. 4 is a perspective view of the vibration damping liner.

Referring now to FIG. 4, liner 44 is shown as a substantially contiguous sheet that may be rolled into the general shape of inner wall 28. In the embodiment illustrated, liner 44 is a flat sheet that is rolled into a cylindrical shape leaving a mating line or gap 54 running the length of the liner. Liner 44 is sized to compress slightly when it is inserted into body 16. This compressed fit within chamber 22 ensures the face-wise relationship between liner's outer surface 48 and inner wall 28. In other embodiments, liner 44 may be tubular in shape (i.e., no mating line 54) and sized to abuttingly fit against wall 28.

It should be appreciated that the inherently resilient nature of the vibration damping material, e.g., a rubber material, of liner 44 will cause it to press against innerwall 28 when liner 44 is compressed and inserted into chamber 22. In other embodiments, liner 44 may be further held against inner wall 28 by adhesives or other fastening means. Liner 44 by continuously abutting the gas spring body 16 during firing, transfers any vibrations in the gas spring 10 to the internally mounted vibration damping material of the liner 44 to reduce the vibration created during the firing process.

Figure 5:
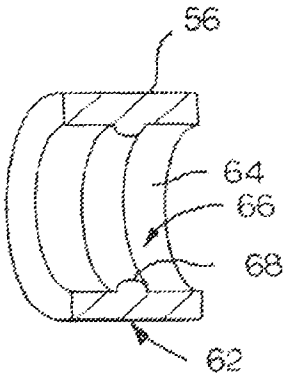
FIG. 5 is a sectional view of one of the guide sleeves.

Referring also now to FIG. 5, in the preferred embodiment, gas spring 10 further includes a pair of guide sleeves 56, 58 mounted to the outer wall 26 of body 16. Each sleeve 56, 58 is generally ring-shaped having a cylindrical outer wall 62 and a concentric opening 64 defined by an inner wall 66. As shown best in FIG. 3, the outer diameter of forward sleeve 56 is sized to slidably mate with the cylindrical inner wall 12*a* of the skirted compression piston 12, while the rearward sleeve 58 is preferably the same diameter as the piston 12.

Each sleeve 56, 58 is preferably a ring of durable and rigid material, such as a plastic. The outer wall 62 of sleeve 56 is preferably smooth and present little frictional resistance to the movement of skirted piston 12 relative to gas spring 10.

Sleeves 56, 58 includes means to grip the outer wall 26 of body 16 and fix the sleeves 56, 58 in place along the body. In the preferred embodiment, sleeves 56, 58 include at least one annular ridge 68 that projects radially inwardly from the inner wall 66. This ridge 68 is preferably shaped complementary to the roll formed channel 25 used to retain plugs 16, 18. The ridge 68 cooperates with channel 25 to fix the sleeves along body 16. It should be appreciated that other fasteners can be used in place of, or in addition to, the ridges/channels to hold the sleeves 56, 58 to the cylindrical body 16.

When an air gun is fired, the unloading of gas spring 10 not only presses compression piston 12 forward, but also creates vibrations in the air gun, which reduces performance. Further, the rapid deceleration of pistons 12 and 34 create additional vibration in the air gun. Sleeves 56, 58, by continuously abutting the skirted compression piston 12 during firing, transfers the vibrations in piston 12 to the liner damped gas spring 10 to reduce the vibration created during the firing process.

Figure 6:
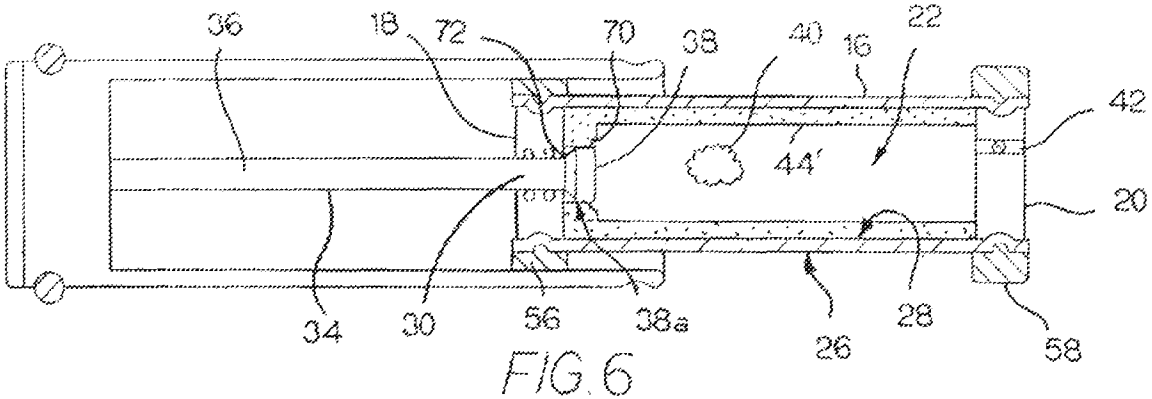
FIG. 6 is a side sectional view of an alternate embodiment of the gas spring's liner with the gas spring in a post-firing position.

In one embodiment, shown in FIG. 6, the liner, denote 44', includes an enlarged annular neck 70 at the forward-most end of the liner. This neck 70 is preferably formed 10 from the same vibration damping material as the rest of the liner and projects radially inward to defines an opening 72 that is concentric to opening 30 and rod 36.

Opening 72 is sized to abuttingly and frictionally mate with the radially outer surface 38*a* of retaining head 38. In one embodiment, opening 72 is slightly smaller than (approximately 0.01 inches) the diameter of head 38.

As shown in FIG. 6, neck 70 only runs along the forward-most end of liner 44', such that neck 70 will not restrict the movement of piston 34 until the piston 34 is substantially at the post-firing position illustrated. The reduced size of neck 70 frictionally restrains the movement of the axially sliding piston 34 and substantially prevents the piston 34 from bouncing back in the direction of arrow 5 after the air gun has been fired.

The direct engagement of the vibration damping liner's neck 70 with piston 34 (which abuts the compression piston 12) provides an additional path for any vibrations in the pistons 12, 34 to travel into the vibration damping material of liner 44' when the gas spring 10 is in the post-firing position.

Figure 7:
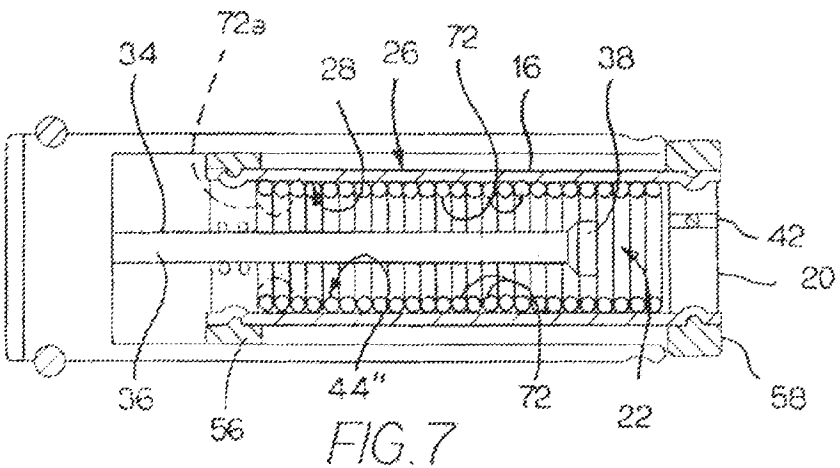
FIG. 7 is a side sectional view of another alternate embodiment of the gas spring's liner with the gas spring in a cocked position.

Referring now to FIG. 7, yet another embodiment of the gas spring liner, denoted 44", is shown as a plurality of individual elastomeric o-rings 72, which are stacked adjacently and abuttingly along the entire length of chamber 22. The o-rings 72 are preferably sized such that they are slightly compressed by wall 28 when inserted into body 16. In another embodiment shown in phantom, the neck 70 shown in FIG. 6 can be replicated by using o-rings 72*a* at the forward-most end of the tube having an appropriately sized inner diameter (i.e., using thicker o-rings).

Figure 8:
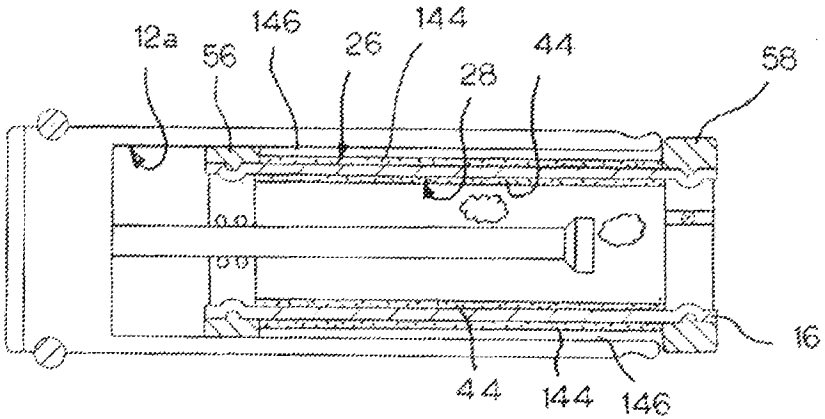
FIG. 8 is a side sectional view of still another embodiment of a gas spring having a liner mounted on both the inner and outer surface of the gas spring cylinder.
Figure 9:
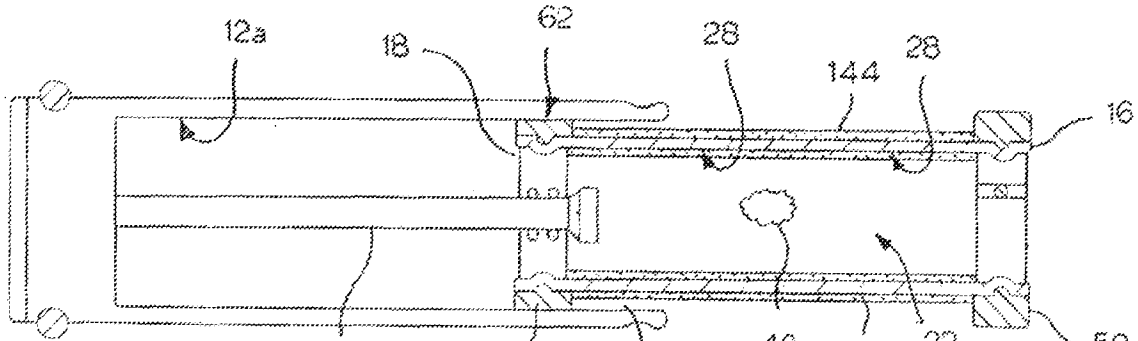
FIG. 9 is a side sectional view of the embodiment illustrated in FIG. 8 in a post-firing position.

Referring now to FIGS. 8 and 9 an alternate embodiment is illustrated where a second liner 144 is mounted to the outer surface 26 of the cylinder. Liner 144 is substantially the same as liner 44 described above, but is abuttingly mounted to outer surface 26 between the sleeves 56, 58. This second layer of vibration damping material acts to supplement the damping effects of the single liner 44 described above.

It should be appreciated that the outer liner 144 is sufficiently thin to ensure that there is clearance, shown as a gap 146, between the liner 144 and the inner surface 12*a* of the piston. In this manner, the vibration damping outer liner 144 does not interfere with the firing and cocking operations of the air gun.

Figure 10:
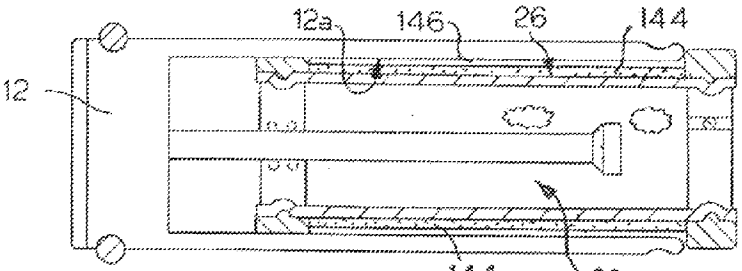
FIG. 10 is a side sectional view of yet another embodiment of a gas spring having a liner mounted to the outer surface of the gas spring cylinder.

In another embodiment, shown in FIG. 10, the inner liner 44 may be eliminated and only the outer liner 144 operates to receive and damp any vibrations in the air gun.

Figure 11:
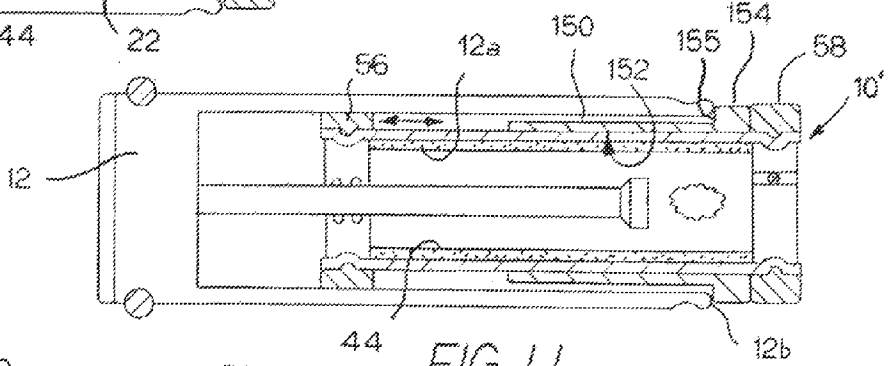
FIG. 11 is a side sectional view of still yet another embodiment of the present invention having a slidable counterweight mounted to the outer surface of the gas spring cylinder, shown in a cocked position.
Figure 12:
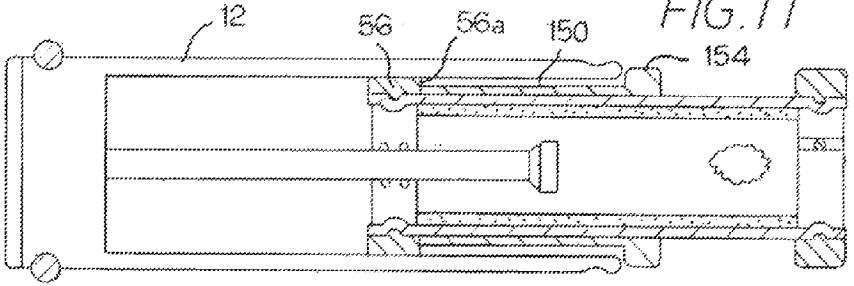
FIG. 12 is a side sectional view of the embodiment illustrated in FIG. 11 in a post-firing position.

Referring now to FIGS. 11 and 12, still another embodiment of invention showing a gas spring 10' having an internal liner 44 as described above. In addition to the vibration damping liner 44, gas spring 10' includes a tubular-shaped counter-weight 150 that is slidably mounted around the outer surface 26 of the gas spring cylinder 16. The inner diameter of the tubular counter-weight is such that a sliding fit exists between the outer surface 26 and the inner surface 152 of the counter-weight.

As shown, the forward portion of counter-weight 150 is sized to fit within the skirted portion of a piston 12, while remaining free to slide axially along the gas spring surface 26 between the guides 56, 58. The rearward end of the counter-weight terminates at an enlarged annular head 154. Head 154 extends radially from the otherwise relatively thin profile such that the rearward end 12*b* of piston 12 may abuttingly engage a forward shoulder 155 of the head.

Counter-weight 150 is preferably formed from a high density material, such as tungsten carbide. In operation, the counter-weight 150 is pressed back adjacent to the rear guide sleeve 58 by the piston 12 when the air gun is cocked. Upon firing, the piston 12 moves rapidly away from the gas spring 16 and counter-weight 150. Once the piston 12 reaches the forward-most point of its travel, it comes to an abrupt stop while causing the pellet in the air gun to fire and the air gun to recoil from the discharge of the pellet and the compressed air. This recoil effect causes the counter-weight 150 to slide axially along the gas spring and strike the rearward side 56*a* of forward guide sleeve 56 to counter the recoil effect of firing the air gun. In other embodiments, shoulder 155 strikes the rearward end 12*b* rather than the forward end of the counter-weight striking the guide sleeve.

In another embodiment, the rear guide sleeve 58 may be eliminated and replaced with counter-weight 150. In this embodiment (not shown), the counter-weight may include, like sleeve 58, means to frictionally mate with the rearward groove 25 in the cylinder 16. In still other embodiments, the counter-weight 150 may be slidably mounted around a gas spring having a vibration damping outer liner 144.

In still other embodiments, the liner may initially be a liquid elastomeric material, which is applied to the body's inner wall 28 (and/or its outer wall 26). In the preferred version of this embodiment, a layer of vibration damping material is sprayed onto the wall(s) as a liquid and allowed to cure or set to form a layer or liner 44.

While the best modes for carrying out the invention have been described in detail, those familiar with the art to which this invention relates will recognize various alternative designs and embodiments for practicing the invention within the scope of the appended claims.

The invention claimed is:

1. An assembly for an air gun having an axially movable compression piston, the assembly comprising:

a gas spring having:

a gas spring body defining a sealed interior chamber containing gas; and a gas spring piston extending into and movable relative to the sealed interior chamber, with a portion of the gas spring piston engaging the compression piston; and a sleeve contacting an outer surface of the gas spring body.

2. The assembly of claim 1, further comprising:

a vibration damping material contacting a portion of the gas spring body; wherein the vibration damping material is in the form of a liner.

3. The assembly of claim 2, wherein the liner extends along a length of an outer surface of the gas spring body.

4. The assembly of claim 2, wherein the liner extends about at least substantially an entire diametrical surface of the gas spring body.

5. An assembly for an air gun having a gas spring, the assembly comprising:

a damping component contacting the gas spring, the damping component damping vibrations in the air gun when the gun is fired; and wherein the gas spring is received at least partially within a compression piston to be received within the air gun, and at least a portion of the damping component is annular and concentrically surrounds the gas spring.

6. The assembly of claim 5, wherein the gas spring has a substantially tubular body and a spring piston, and the damping component is concentrically mounted with respect to the gas spring and configured to counter recoil of the air gun after firing of the air gun.

7. The assembly of claim 5, wherein the gas spring has a substantially tubular body; and further comprising a counter-weight concentrically mounted to the body, wherein the counter-weight slides axially with respect to the body to strike a portion of the air gun after firing of the air gun.

8. An assembly for an air gun having a gas spring, the assembly comprising:

a substantially tubular sleeve that receives and abuts the gas spring, wherein the sleeve is effective to damp vibrations in the air gun after firing of the air gun;

wherein the gas spring has a substantially tubular body and partially defines a sealed gas chamber; and wherein the sleeve is a layer of damping material fixed to an outer surface of the tubular body.

9. The assembly of claim 8, wherein the sleeve concentrically surrounds at least a portion of the gas spring and is configured to contact the gas spring.

10. The assembly of claim 8, wherein the gas spring has a spring piston; and wherein the sleeve moves free from contact with the spring piston.

11. The assembly of claim 8, further comprising: a counter-weight concentrically mounted with respect to the gas spring and configured to counter recoil in the air gun after firing of the air gun.

12. The assembly of claim 11, wherein the counter-weight is mounted concentrically to the body and is configured to slide axially with respect to the body to strike a portion of the air gun after firing of the air gun.

13. An assembly for an air gun having a compression tube and an axially movable compression piston in the compression tube, the assembly comprising:

a gas spring having:

a gas spring body defining a sealed interior chamber containing gas; and a gas spring piston extending into and movable relative to the sealed interior chamber, the interior chamber remaining sealed and substantially retaining the gas when the gas spring piston moves, with the gas spring piston engaging the compression piston; and a sleeve contacting an outer surface of the gas spring body and a portion of the compression piston.

14. The assembly of claim 13, wherein the gas spring is received at least partially within the compression piston to be received within the air gun, and at least a portion of the sleeve is annular and concentric with the gas spring.

15. The assembly of claim 13, wherein the compression piston moves relative to the sleeve.

16. An assembly for an air gun having a compression tube, an axially movable compression piston in the compression tube and a gas spring at least partially disposed within the compression tube, the assembly comprising:

a damping component contacting the gas spring and the compression piston, the damping component damping vibrations in the air gun when the gun is fired; and wherein the gas spring is received at least partially within the compression piston to be received within the air gun, and at least a portion of the damping component is annular and is concentric with the gas spring.

17. The assembly of claim 16, wherein the gas spring includes:

a gas spring body defining a sealed interior chamber containing gas; and a gas spring piston extending into and movable relative to the sealed interior chamber, the interior chamber remaining sealed and substantially retaining the gas when the gas spring piston moves, the gas spring piston connected to the compression piston to move the compression piston from a loaded to an unloaded position.

18. An assembly for an air gun having a compression tube and an axially movable compression piston in the compression tube, the assembly comprising:

a gas spring having:

a gas spring body defining a sealed interior chamber containing gas; and a gas spring piston extending into and movable relative to the sealed interior chamber, the interior chamber remaining sealed and substantially retaining the gas when the gas spring piston moves, with the gas spring piston engaging the compression piston; and a sleeve contacting an outer surface of the gas spring body and a portion of the compression tube.

19. The assembly of claim 18, wherein the sleeve is a damper.

20. An assembly for an air gun having a gas spring at least partially disposed within a compression tube, the assembly comprising:

a damping component contacting the gas spring and the compression tube, the damping component damping vibrations in the air gun when the gun is fired; and wherein the gas spring is received at least partially within a compression piston to be received within the air gun, and at least a portion of the damping component is annular and concentric with the gas spring.

21. The assembly of claim 20, wherein the damping component is a sleeve; wherein the gas spring includes a gas spring body supported by the sleeve concentrically relative to the compression tube; the gas spring body defining a sealed interior chamber containing gas; and a gas spring piston extending into and movable relative to the sealed interior chamber, the interior chamber remaining sealed and substantially retaining the gas when the gas spring piston moves, with the gas spring piston engaging the compression piston.

* * * * *